United States Patent [19]

Hunt

[11] 4,170,924

[45] Oct. 16, 1979

[54] HYDRAULICALLY POWERED PERCUSSIVE APPARATUS

[75] Inventor: Clive W. Hunt, Randburg, South Africa

[73] Assignee: Compair Sa (Proprietary) Limited, Transvaal, South Africa

[21] Appl. No.: 812,406

[22] Filed: Jul. 1, 1977

[30] Foreign Application Priority Data

Jul. 15, 1976 [ZA] South Africa ..... 76/4220

[51] Int. Cl.[2] ..... F01L 21/02; F01B 7/18

[52] U.S. Cl. ..... 91/232; 91/235

[58] Field of Search ..... 91/235, 321, 232, 234, 91/325; 92/134

[56] References Cited

U.S. PATENT DOCUMENTS

| | | | |
|---|---|---|---|
| 1,829,246 | 10/1931 | Smith, Sr. et al. | 91/235 |
| 2,104,468 | 1/1938 | Osborn | 91/235 |
| 3,376,790 | 4/1968 | Matson | 91/235 |
| 3,774,502 | 11/1973 | Arndt | 91/321 |
| 4,028,995 | 6/1977 | Salmi et al. | 91/321 |

*Primary Examiner*—Paul E. Maslousky

*Attorney, Agent, or Firm*—Burns, Doane, Swecker & Mathis

[57] ABSTRACT

Hydraulically powered percussive apparatus for breaking rock, drilling etc. in which a combined spool valve and hammer reciprocates in the bore of a cylinder structure. A high pressure fluid inlet leads to the bore and a low pressure outlet leads from the bore. A fluid flow passage communicates with the bore at two axially spaced locations. As the hammer reciprocates, it cyclically connects, via the bore, the inlet to the passage and the outlet to the passage. Pressures in the inlet and outlet fluctuate between fairly narrow limits whereas the pressure in the passage fluctuates between a pressure approximating inlet pressure and a pressure approximating outlet pressure. The hammer has two operating faces. The first of these is exposed to the relatively steady inlet pressure and the second is subjected to the widely varying pressure in the passage. The direction of the resultant force on the hammer reverses at the pressure in the passage varies from approximately inlet pressure to approximately outlet pressure.

8 Claims, 12 Drawing Figures

HYDRAULICALLY POWERED PERCUSSIVE APPARATUS

Figure 1:
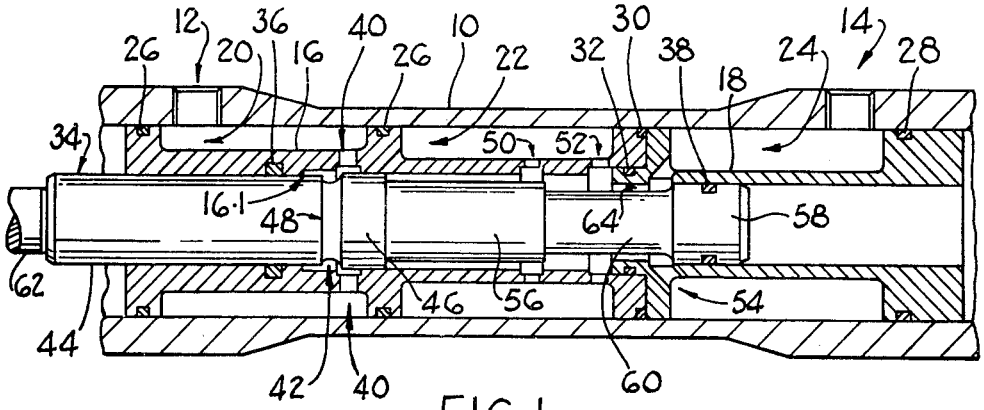

This invention relates to a hydraulically powered percussive apparatus.

According to the present invention there is provided an hydraulically powered percussive apparatus comprising a cylinder structure having a bore, a combined spool valve and hammer reciprocable in the bore, a high pressure inlet to said bore, a low pressure outlet from said bore, means defining a fluid transfer path, said transfer path being placed alternately in communication with said inlet and outlet via said bore as said hammer reciprocates, and said hammer having a face permanently exposed to inlet pressure and a face permanently exposed to the varying pressure in said transfer path, that face of the hammer which is exposed to the pressure subsisting in said transfer path having an area larger than the area of the face which is exposed to the pressure subsisting at the inlet, the forces on these two faces acting in opposite directions.

In one constructional form, said transfer path is constituted by an annular chamber which encircles said bore and there are first and second axially spaced flow paths connecting said chamber to the bore, said hammer cyclically placing said inlet in communication with said transfer path via said first flow path and the bore, and said outlet in communication with said transfer path via said second flow path and the bore.

According to another constructional form, said transfer path is constituted by a passage which extends axially of said cylinder structure, and there are two axially spaced flow paths connecting said passage to the bore, said hammer cyclically placing said inlet in communication with said transfer path via said first flow path and the bore, and said outlet in communication with said transfer path via said second flow path and the bore.

In both these forms, it is preferred that said inlet, outlet and flow paths communicate with the bore at axially spaced locations.

To dampen pressure shocks, an accumulator can be connected to each of said inlet, outlet and transfer path.

It is preferred that the inlet communicate with a variable volume annular zone of said bore which zone encircles the hammer and is bounded at one end by a fixed end surface and at the other end by said face of said hammer which is exposed to inlet pressure. Additionally it is desirable that at least said second flow enters a variable volume annular zone of said bore which zone encircles the hammer and is bounded at one end by a fixed end surface and at the other end by said face of said hammer which is exposed to pressure in said transfer path.

For simplicity of construction, the hammer can include three portions of different diameters with the larger diameter portion between the other two.

For a better understanding of the present invention reference will now be made, by way of example, to the accompanying drawings in which:

FIGS. 1 to 6 illustrate a first form of hydraulically operated percussive apparatus; and FIGS. 7 to 12 illustrate a second form of hydraulically operated percussive apparatus.

The structure of FIGS. 1 to 6 will be described with reference to FIG. 1 and the operation with reference to all of FIGS. 1 to 6. In FIGS. 2 to 6 only those reference numerals have been inserted which are necessary for an understanding of the operative stage being described. A similar approach has been adopted in respect of FIGS. 7 to 12 where structure is described in relation to FIG. 7 and operation in relation to all Figures.

The apparatus illustrated in FIG. 1 comprises a cylinder structure having a high pressure inlet 12 and a low pressure outlet 14. The cylinder structure comprises a barrel 10 and two fixed elements 16 and 18 within the barrel 10. These elements, in co-operation with the barrel 10, define an annular high pressure chamber 20, an annular variable pressure chamber 22 and an annular low pressure chamber 24. The inlet 12 leads to the chamber 20, and the outlet 14 leads from the chamber 24. The bore of the element 16 is stepped internally at 16.1 so that the inside diameter of the left hand portion is less than that of the right hand portion. The bore of the element 18 is of constant internal diameter, the internal diameter of the element 18 being less than either of the internal diameters of the element 16.

Seals 26 are provided between the element 16 and the barrel 10, and a seal 28 is provided between the element 18 and the barrel 10. A further seal 30 has the dual function of sealing between the elements 16 and 18, and between these elements and the barrel 10. Yet another seal 32 is provided where the element 18 has a spigot portion thereof entered in a socket of the element 16.

A combined spool valve and hammer 34 is reciprocable in the bore of the cylinder structure which bore is bounded by the elements 16 and 18, there being a seal 36 between the element 16 and the hammer 34, and a seal 38 between the element 18 and the hammer 34.

A ring of ports 40 leads through the element 16 from the chamber 20 to an annular zone 42 bounded externally by the element 16 and internally by the hammer 34. On each side of the zone 42 there are cylindrical portions 44 and 46 of the hammer 34, the portion 44 being slightly smaller in outside diameter than the portion 46. During manufacture a groove 48 is provided in the hammer which groove separates the portions 44 and 46. By virtue of the different outside diameters of the portions 44 and 46, the right hand face of the groove 48 is of larger area than the left hand face.

Two rings of ports 50 and 52 lead through the element 16 and place the chamber 22 in communication with the interior of the element 16. The rings of ports 50 and 52 are spaced from one another axially along the element 16. Similarly a ring of ports 54 is provided in the element 18 and places the chamber 24 in communication with the interior of the element 18.

In addition to the portions 44 and 46, the hammer 34 includes cylindrical portions 56 and 58 of relatively large and equal diameters separated by a cylindrical portion 60 which has the smallest diameter of all the portions of the hammer 34.

The drill steel which the hammer 34 strikes is shown at 62.

As the hammer 34 reciprocates, its various portions move relatively to the elements 16 and 18 and to the rings of ports therein. This creates a variety of different annular zones which change in configuration and size during the operating cycle. These zones will be described in detail, and designated with reference numerals, as the operation of the apparatus is explained.

In the condition illustrated in FIG. 1, the hammer 34 has just impacted on the steel 62 and is about to commence its return stroke, i.e., it is about to move to the right.

The high pressure chamber 20 communicates with the zone 42 by way of the ports 40. As mentioned, the area of the right hand face of the groove 48 is greater than the area of the left hand face. Thus there is a net force acting to the right and, under the influence of this force, the hammer commences its return stroke. At this stage, the chamber 24 communicates via the ports 54, an annular zone 64 encircling the portion 60 and the ports 52 and 54 with the variable pressure chamber 22. Thus the chamber 22 is exhausting via the outlet 14. As will be further explained hereinafter, the chamber 22 was previously in communication with the inlet 20. Thus its pressure at this time is decreasing from substantially inlet pressure to substantially exhaust pressure.

Figure 2:
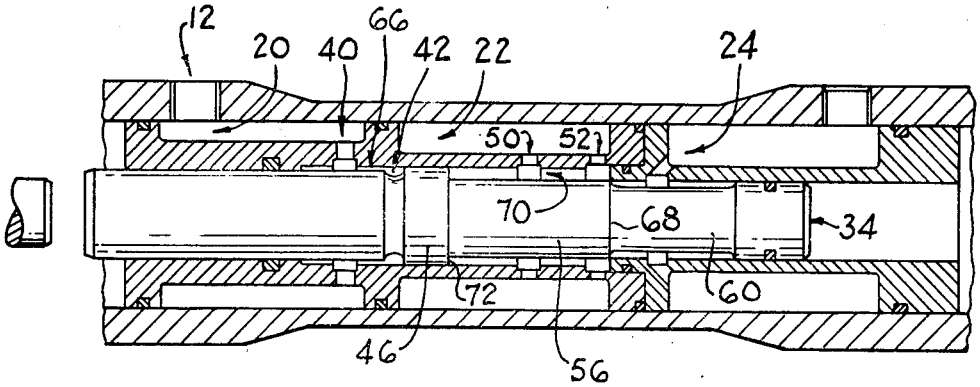

In FIG. 2 the hammer 34 has travelled a short distance to the right. The zone 42 is still in communication with the inlet 12 via the chamber 20, the ports 40 and an annular zone 66 so that the net force urging the hammer 34 to the right is still effective. A face 68 between the portions 56 and 60 has just entered the left hand end of the element 18 and this has the effect of cutting-off communication between the low pressure chamber 24 and the variable pressure chamber 22. Before communication is cut-off, the pressures in the chambers 22 and 24 are substantially equalized. Further movement of the hammer to the right reduces the total volume of the chamber 22 and the annular zone 70 which, at this stage, encircles the portion 56 and is connected to the chamber 22 by the ports 50 and 52. More specifically, an annular face 72 forming one end wall of the zone 70 moves to the right whereas the other boundary of the zone 70 (constituted by the left hand face of the element 18) remains stationary.

Figure 3:
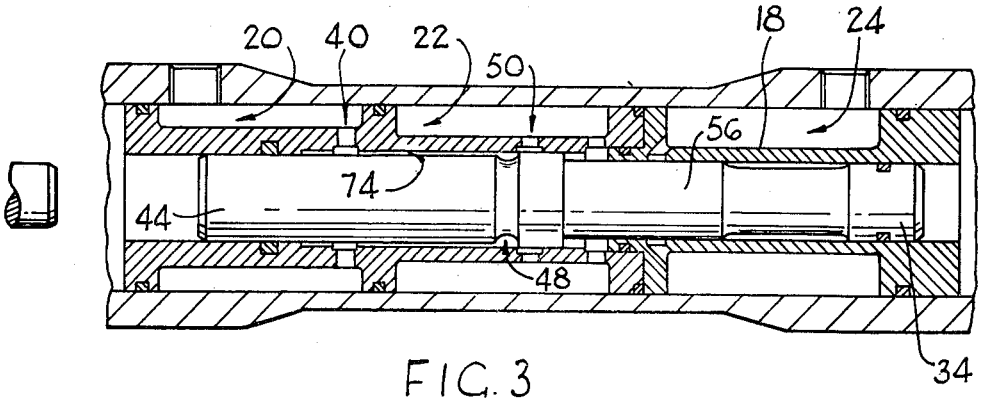

In FIG. 3 the hammer is approaching the end of its travel to the right and communication is just about to be established between the chamber 20 and the chamber 22 via the ports 50, the groove 48, an annular zone 74 encircling the portion 44 and the ports 40. The portion 56, by virtue of its sealing engagement with the element 18, still prevents communication between the chambers 22 and 24.

Figure 4:
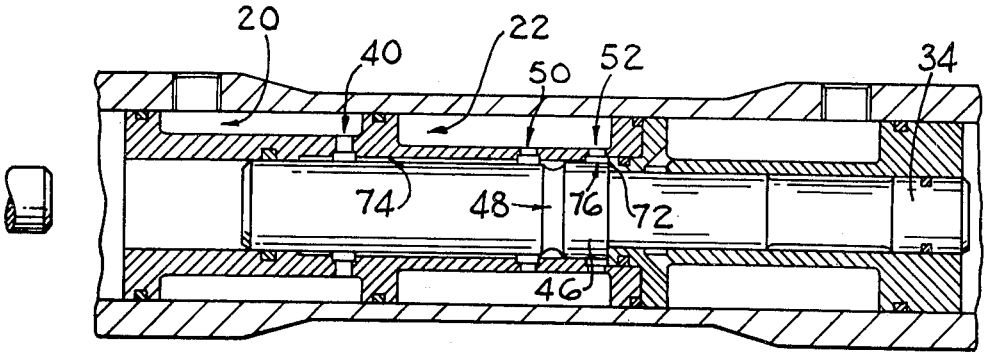
Figure 5:
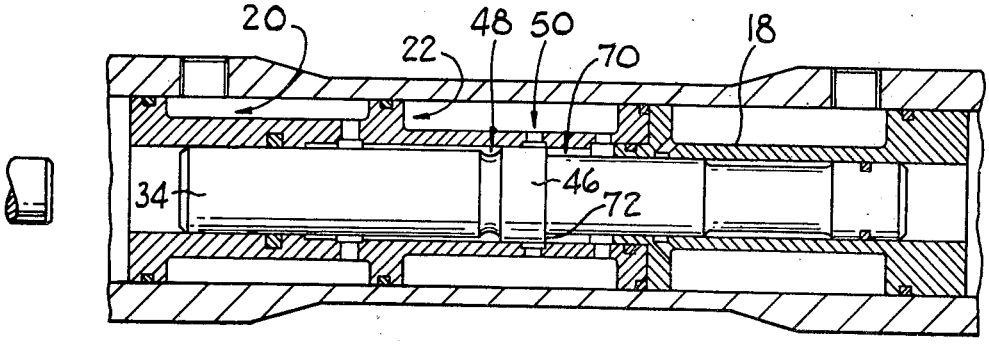
Figure 6:
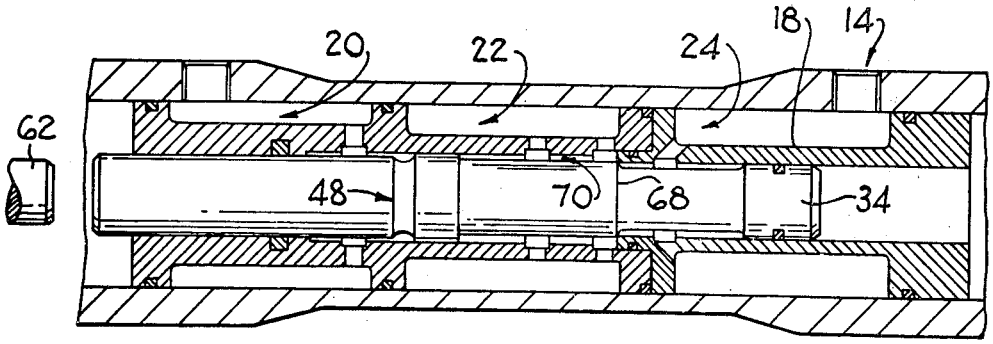

The hammer 34 is shown at the right hand end of its return stroke in FIG. 4. The chambers 20 and 22 are in communication via the ports 40 and 50 and the annular zone 74. High pressure flow now has access via the ports 50, the chamber 22 and the ports 52 to an annular zone 76 which encircles the portion 46. The face 72 of the portion 46 is thus subjected to fluid which is substantially at inlet pressure. Hence the faces which are now subjected to inlet pressure are the two faces bounding the groove 48 and the face 72. This means that the total area on which pressure fluid acts to force the hammer to the left greatly exceeds the area on which pressure fluid acts to force the hammer to the right so that the hammer commences its working stroke.

It should be mentioned here that should the increasing pressure acting on the face 72 as the hammer completes its return stroke be insufficient to stop its movement, then mechanical contact between the left hand end of the element 18 and the face 72 does so. Such contact is, however, undesirable.

As the hammer moves to the left (see FIG. 5) the groove 48 moves out of register with the ports 50 so that the chamber 22 is cut-off from the chamber 20. The portion 46 acts as a seal. The volume of the annular zone 70 steadily increases as the face 72 moves away from the element 18. The pressure in the chamber 22 thus decreases and the pressure energy initially stored and is expended in driving the hammer 34 to the left. Immediately prior to impact of the hammer 34 on the steel 62, the face 68 clears the left hand end of the element 18 so that the chamber 22 is placed in communication with the chamber 24 and hence with the outlet 14. The resultant drop in pressure in the chamber 22, and in the zone 70 connected thereto, means that the only significant pressure acting on the hammer is that existing in the groove 48. The net force acting to the right, and derived from the difference in areas between the faces of the groove 48, is insufficient to overcome the momentum of the hammer 34 which continues to the left until it impacts on the steel 62. At this point the position of FIG. 1 has been reached and the pressure acting on the different area faces of the groove 48 causes the hammer to commence its next return stroke.

The chambers 20, 22 and 24 act as accumulators and advantage is taken of the compressibility of hydraulic fluid at the pressures involved. The total volume of the chamber 20, and the zone 74 connected thereto, decreases during the working stroke and energy is stored in this chamber which is expended during the return stroke. The function of the chamber 22 has already been described, and the function of the chamber 24 is to 'smooth' flow through the ports 54. The rate of movement of the hammer 34 can be from 20 cycles per second to 150 cycles per second so that fluid pulses enter the chamber 24 at this rate. The rate of flow from the outlet 14 is steadier and less pulsating than that at the ports 54.

If desired, gas or spring accumulators can be connected to the chambers 20, 22 and 24.

Figure 7:
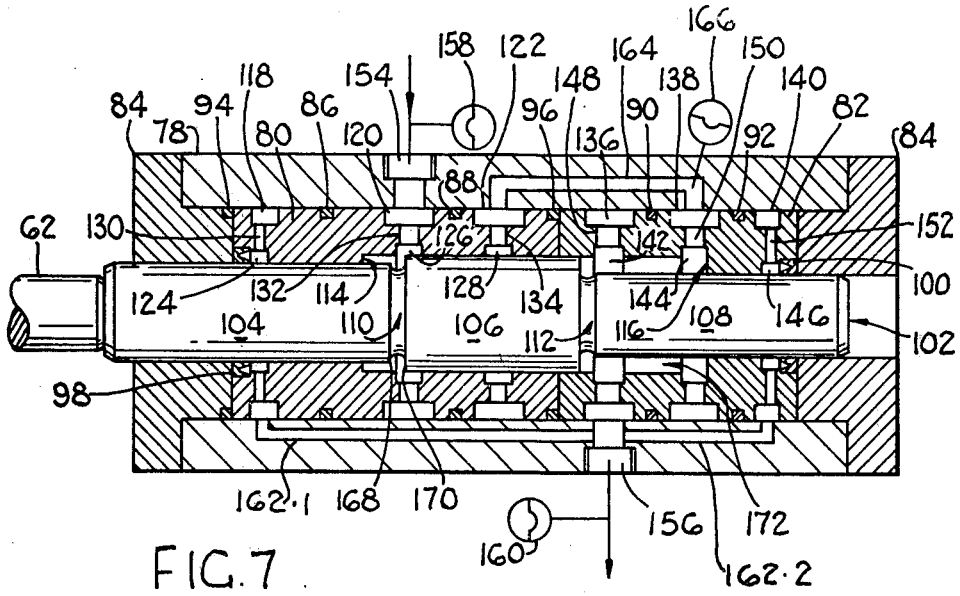

Turning now to FIG. 7, this form of apparatus comprises a cylinder structure including a barrel 78 in which there are two axially aligned fixed elements 80 and 82. The cylinder structure also includes two end caps 84, the caps 84 being secured to the barrel 78.

O-ring seals 86 and 88 are provided for sealing between the fixed element 80 and the barrel 78 and further O-ring seals 90 and 92 are provided for sealing between the element 82 and the barrel 78. An additional O-ring seal 94 is carried by the left hand cap 84 and another O-ring seal 96 is provided for sealing where the elements 80 and 82 abut. Lip seals 98 and 100 are carried by the elements 80 and 82 respectively and seal between these elements and a reciprocable hammer and spool valve 102.

The hammer 102 has three cylindrical portions 104, 106 and 108. The portion 106 is of greatest diameter and the portion 108 of smallest diameter. For manufacturing reasons, grooves 110 and 112 are provided between the portions 104, 106 and 106, 108 respectively.

The internal cylindrical face of the element 80 is stepped at 114 thereby to provide a smaller diameter bore in which the portion 104 is received and a larger diameter bore in which the portion 106 is received. The internal cylindrical face of the element 82 is similarly stepped at 116 so as to provide a smaller diameter bore for receiving the portion 108 and a larger diameter bore (equal in diameter to the larger diameter bore of the element 80) for receiving the portion 106.

Three external annular grooves 118, 120 and 122, three corresponding internal annular grooves 124, 126 and 128, and three rings of ports 130, 132 and 134 placing corresponding pairs of annular grooves in communication with one another are machined in the element 80. Similarly three external annular grooves 136, 138 and 140, three internal annular grooves 142, 144 and 146, and three rings of ports 148, 150 and 152 are machined in the element 82.

A high pressure inlet 154 to the cylinder structure communicates with the groove 120 and a low pressure outlet 156 communicates with the groove 136. Gas, liquid or spring accumulators diagrammatically shown at 158 and 160 communicate respectively with the inlet 154 and outlet 156.

The grooves 118 and 140 are placed in communication with the outlet 156 by way of passages in the barrel 78, these passages being shown diagrammatically at 162.1 and 162.2. Similarly the grooves 122 and 138 are placed in communication with one another by way of a passage in the barrel 78, this latter passage being diagrammatically shown at 164. An accumulator 166 is connected to the passage 164.

As the hammer 102 reciprocates, its various portions move relatively to the elements 80 and 82. This creates a variety of different annular zones which change in configuration and size during the operating cycle. These zones will be described in detail, and designated with reference numerals, as the operation of the apparatus is explained.

In the position illustrated in FIG. 7, the hammer 102 has just completed its working stroke to the left and has impacted on the steel 62. At this stage, the faces 168 and 170 of the groove 110 are the only faces of the hammer 102 which are subjected to full inlet pressure via the grooves 120 and 126 and the ports 132. The resultant force on the hammer 102 is to the right as the face 170 has a greater area than the face 168.

An annular zone 172 encircling the portion 108 is in communication with both grooves 142 and 144 and, via these grooves and the ports 148 and 150, with the outlet 156 and the passage 164. At this stage the pressure in this passage and in all the ports and grooves connected thereto is decaying towards outlet pressure.

Figure 8:
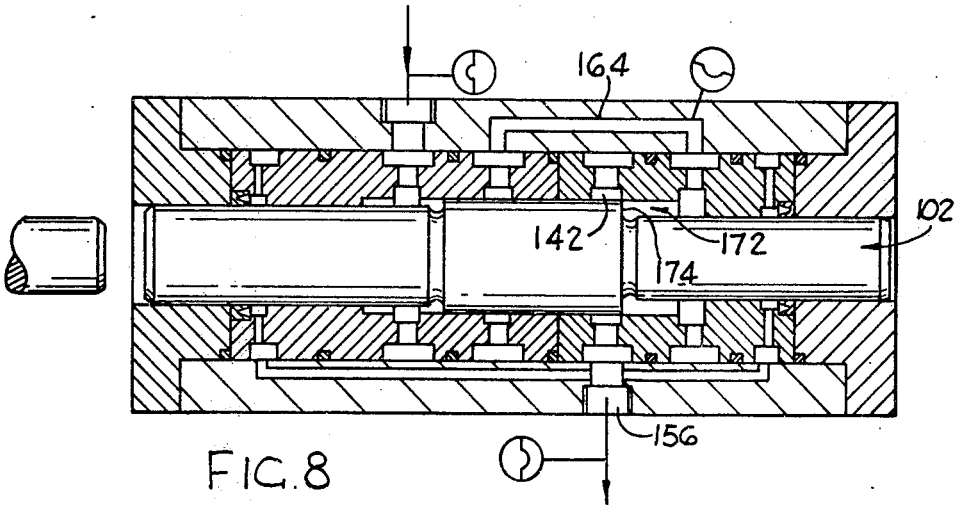

In FIG. 8, the hammer has moved to the right sufficiently far to have caused an end face 174 of the hammer 102 to terminate free communication between the groove 142 and the zone 172, and hence between this zone and the outlet 156. Thus the pressure in the zone 172, passage 164 and all the grooves and ports connected to the passage 164 commences to rise and the face 174 is subjected to an increasing force resisting movement of the hammer 102 to the right.

Figure 9:
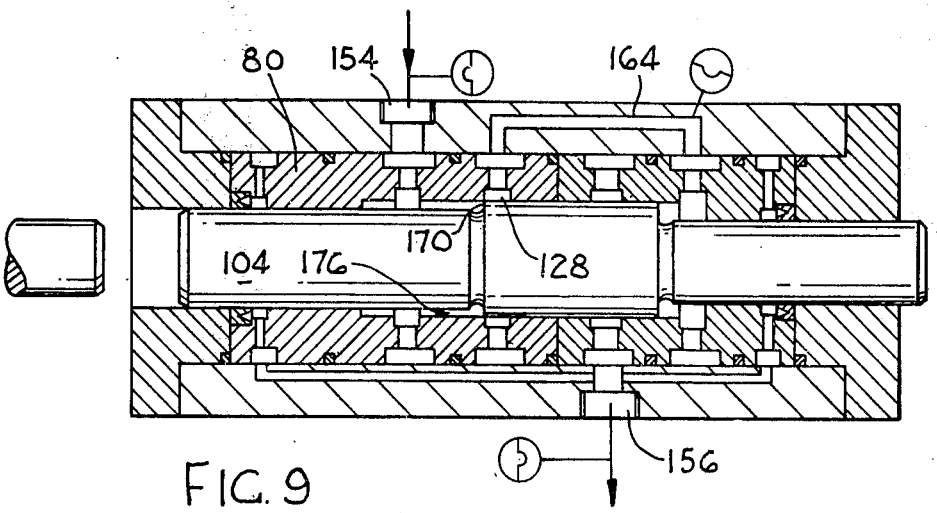

In FIG. 9 substantially the same conditions subsist as in FIG. 8. The face 170 has almost reached the groove 128 and the passage 164 remains cut-off from both the inlet 154 and the outlet 156. An annular zone 176 now exists between the element 80 and the portion 104.

Figure 10:
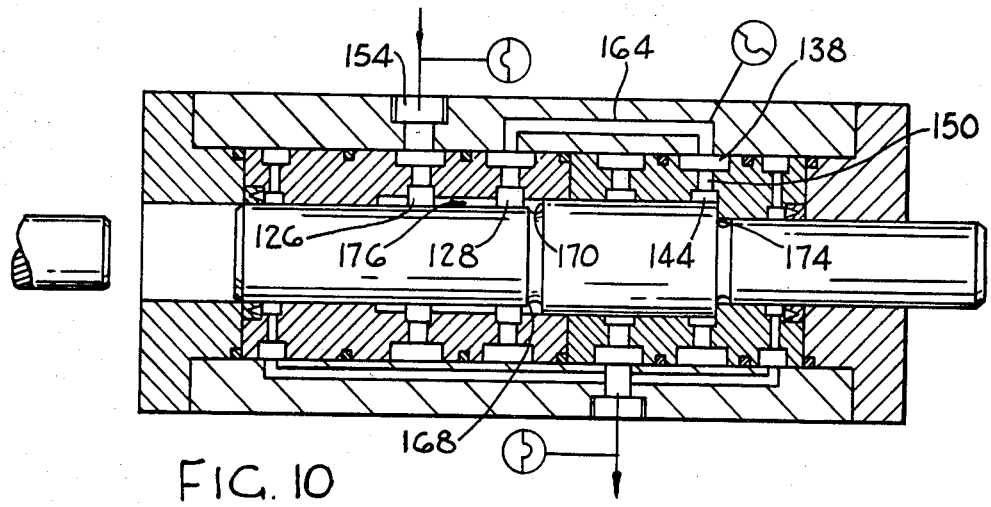

FIG. 10 illustrates the end of the return stroke of the hammer 102. Immediately the face 170 passes the left hand edge of the groove 128, the passage 164 is placed in communication with the inlet 154 via the zone 176. Thus the pressure in the passage 164 rises rapidly to substantially full supply pressure. By way of the grooves 138 and 144 and the ports 150, this pressure is applied to the face 174 slowing the hammer to a halt and then commencing to move it in its working stroke. It will be understood that the sum of the areas of the faces 168 and 174 exceeds the area of the face 170.

Figure 11:
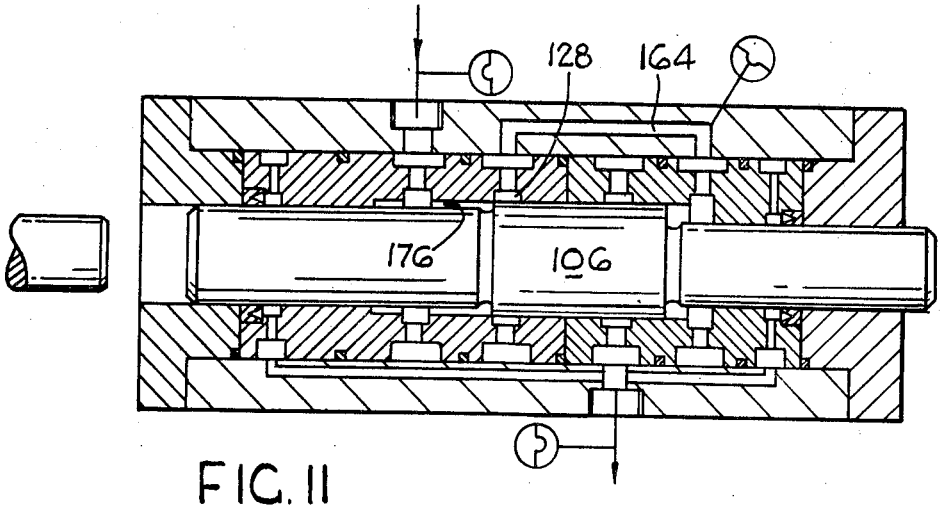

During the first part of the working stroke of the hammer, the passage 164 remains in communication with the inlet 154. However, as the position of FIG. 11 is reached, the portion 106 seals-off the groove 128 from the zone 176. During the remainder of the working stroke pressure in the passage 164 decays.

Figure 12:
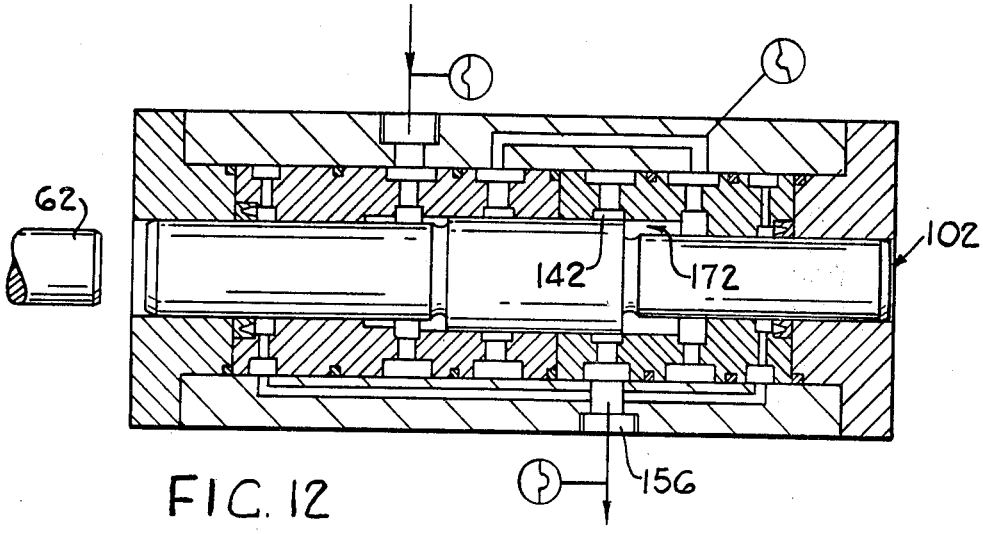

As the hammer 102 passes the position shown in FIG. 12, the zone 172 is placed in communication with the outlet 156 and the residual pressure in the passage 164 and the zone 172 drops more rapidly towards outlet pressure.

The hammer thereafter impacts on the steel 62 and the cycle is complete.

The grooves 120 and 126 and the ports 132 together constitute a first chamber communicating permanently with the high pressure inlet 154 and with the bore. Similarly, the grooves 136 and 142 and the ports 148 constitute a second chamber which communicates with the outlet 156 and with the bore. The passage 164 constitutes a third chamber in which the pressure varies and which is placed alternately in communication with the inlet 154 and the outlet 156.

I claim:

1. Hydraulically powered percussive apparatus comprising a cylinder structure having a bore, a combined spool valve and hammer reciprocable in the bore, the spool valve and hammer including a middle portion, a first end portion and a second end portion, the three portions being co-axial and cylindrical, and the middle portion being of larger diameter than either of the end portions with said first end portion of greater diameter than the second end portion, the bore being stepped to provide two annular surfaces and three portions which receive said portions of said combined spool valve and hammer, a first annular face between said first end portion and said middle portion, said first face bounding one end of a first annular zone which encircles said hammer, the other end of said zone being bounded by one of said surfaces of the stepped bore, a high pressure inlet to said first annular zone, a second annular face between said second end portion and said middle portion, said second annular face bounding one end of a second annular zone which encircles said hammer, the other end of said second zone being bounded by the other of said annular surfaces of the stepped bore, a low pressure outlet from said bore, means defining a fluid transfer path, said transfer path being placed alternately in communication with said inlet and outlet via said annular zones as said hammer reciprocates, said second face of the hammer which is exposed to the pressure subsisting in said transfer path having an area larger than the area of said first face which is continuously exposed to the pressure subsisting at the inlet, the forces on these two faces acting in opposite directions.

2. Apparatus according to claim 1, in which said transfer path is constituted by a passage which extends axially of said cylinder structure, and there are two axially spaced flow paths connecting said passage to the bore, said hammer cyclically placing said inlet in communication with said transfer path via said first flow path and the bore, and said outlet in communication with said transfer path via said second flow path and the bore.

3. Apparatus according to claim 2, in which said inlet, outlet and flow paths communicate with the bore at axially spaced locations.

4. Apparatus according to claim 2, in which said first flow path enters the bore between said inlet and outlet.

5. Apparatus according to claim 1, and including accumulators connected to said inlet, said outlet and said transfer path.

6. Apparatus according to claim 1, in which said transfer path is constituted by an annular chamber which encircles said bore and there are first and second axially spaced flow paths connecting said chamber to the bore, said hammer cyclically placing said inlet in communication with said transfer path via said first flow path and the bore, and said outlet in communication with said transfer path via said second flow path and the bore.

7. Apparatus according to claim 6, in which said inlet, outlet and flow paths communicate with the bore at axially spaced locations.

8. Apparatus according to claim 6, in which both said flow paths enter the bore between the inlet and the outlet.

* * * * *